United States Patent [19]

Watanabe et al.

[11] Patent Number: 4,494,885

[45] Date of Patent: Jan. 22, 1985

[54] COMPACT PRINTER

[75] Inventors: Satoshi Watanabe; Toru Wakasawa; Hirofumi Hirano; Hiroshi Nishizawa, all of Chichibu, Japan

[73] Assignees: Canon Kabushiki Kaisha, Tokyo; Canon Denshi Kabushiki Kaisha, Chichibu, both of Japan

[21] Appl. No.: 407,296

[22] Filed: Aug. 11, 1982

Related U.S. Application Data

[63] Continuation of Ser. No. 155,157, May 30, 1980, abandoned.

[30] Foreign Application Priority Data

| | | | |
|---|---|---|---|
| Jun. 4, 1979 | [JP] | Japan | 54-69664 |
| Jun. 4, 1979 | [JP] | Japan | 54-69665 |
| Jun. 4, 1979 | [JP] | Japan | 54-69666 |
| Jun. 5, 1979 | [JP] | Japan | 54-70411 |
| Jun. 29, 1979 | [JP] | Japan | 54-82373 |
| Aug. 10, 1979 | [JP] | Japan | 54-102625 |

[51] Int. Cl.[3] ..... B41J 9/12; B41J 1/18; B41J 1/20

[52] U.S. Cl. ..... 400/145.2; 400/146; 400/170; 400/470; 400/142; 400/157; 101/111; 101/93.09; 101/93.23

[58] Field of Search ..... 400/146, 145.2, 470, 400/170, 471

[56] References Cited

U.S. PATENT DOCUMENTS

| | | | |
|---|---|---|---|
| 369,401 | 9/1887 | Enjalbert | 400/145.2 |
| 672,680 | 4/1901 | Marshman | 400/145.2 |
| 723,855 | 3/1903 | Frantz | 400/145.2 |
| 1,328,156 | 1/1920 | Kousnetzoff et al. | 400/145.2 |
| 1,450,627 | 4/1923 | Darnley | 400/146 |
| 2,874,637 | 2/1959 | Grevich | 101/377 |
| 3,169,474 | 2/1965 | Howard | 101/110 |
| 3,295,652 | 1/1967 | Sasaki | 400/174 |
| 3,326,346 | 6/1967 | Sasaki | 101/111 |
| 3,717,234 | 2/1973 | Koller | 400/174 |
| 3,848,527 | 11/1974 | Nihira | 101/93.23 |
| 3,890,895 | 6/1975 | Deproux | 101/111 |
| 3,944,052 | 3/1976 | Boyden | 400/145.2 |
| 3,949,672 | 4/1976 | Cadmus, Jr. | 101/368 |
| 4,006,686 | 2/1977 | Ackerman | 101/415.1 |
| 4,013,005 | 3/1977 | Keefe | 101/376 |
| 4,072,460 | 2/1978 | Gazzard et al. | 101/415.1 |
| 4,075,945 | 2/1978 | Bienholz | 400/146 |

FOREIGN PATENT DOCUMENTS

| | | | |
|---|---|---|---|
| 1190506 | 5/1970 | United Kingdom | 400/174 |

*Primary Examiner*—William Pieprz

*Attorney, Agent, or Firm*—Fitzpatrick, Cella, Harper & Scinto

[57] ABSTRACT

A compact printer having a typefont belt constituting a typefont wheel maintained under tension on a support, wherein the platen is rendered displaceable in a direction away from the typefont wheel after the completion of the printing operation, and the front end of a hammer provided in the typefont wheel is inclined upwards.

12 Claims, 65 Drawing Figures

COMPACT PRINTER

This is a continuation, of application Ser. No. 155,157, filed May 30, 1980, now abandoned.

BACKGROUND OF THE INVENTION

1. Field of the Invention

The present invention relates to a compact printer adapted for use for example in an electronic table-top calculator.

2. Description of the Prior Art

Conventionally the typefont wheel for use in a compact printer is composed, as shown in FIGS. 1 and 2, of a typefont belt 2 of an elastic material having a desired number of types or symbols 1 and mounted on a cylindrical support 3. Said mounting is achieved by an adhesive material 4 or by fusion.

However such mounting method poses extreme difficulty in exact positioning of types 1, eventually leading to aberrated print positions.

As an example, in case of a typefont belt having thirteen types or symbols and wound around a cylindrical support 3, with dimensions of an outer diameter of 25 mm of the typefont belt; a character pitch of 5.2 mm and a character length of 2.6 mm, there will result, at the final type 5 as shown in FIG. 3, a positional aberration of 0.6 mm from the normal position A in case of a contraction of 50 microns in the character pitch. Thus, in case of printing on a paper 6, the characters appear as lacking approximately a quarter thereof, as shown in FIG. 4 (see numerals 1, 2, 3, 7 and 8).

Also where the typefont belt is fixed by means of the adhesive material 4 as shown in FIG. 2, the change in the character pitch may further be caused by the change in the thickness of the adhesive material.

Inversely in case of the typefont wheel shown in FIG. 3, an elongation of the character pitch by 50 microns will result in an entire elongation of 0.6 mm, forming a slack in the belt 2 as shown in FIG. 5 which causes stains on the print.

Particularly in case the typefont wheel is utilized in a printer of flying hammer type, an elevated precision is required for the typefont wheel in order to minimize other factors affecting the precision such as uneven rotation of the motor, fluctuation in the hammer flying type etc., but such requirement is extremely difficult to satisfy in the fixation with adhesive material or with fusion because of the difficulty in the assembly.

SUMMARY OF THE INVENTION

In consideration of the above-mentioned drawbacks in the prior art, the object of the present invention is to provide an easily workable inexpensive typefont wheel capable of easily achieving an improved precision and adapted for mass production.

According to the present invention, the typefont wheel for a small printer, composed of a typefont belt made of an elastic member and mounted on a support is characterized in that said typefont belt is provided with at least two positioning projections which are respectively fitted in recesses of a wider distance thereby mounting said typefont belt under a tension on said support.

BRIEF DESCRIPTION OF THE DRAWING

FIGS. 6–12 illustrate a compact printer adapted for using the typefont wheel of the present invention, wherein FIG. 6 is an exploded perspective view of the principal parts thereof;

FIG. 7 is a partially cut-off elevation view thereof;

FIG. 8 is a lateral cross-sectional view thereof;

FIG. 9 is a frontal cross-sectional view thereof;

FIG. 10 is a lateral cross-sectional view of an ordinary typefont wheel employed in the compact printer shown in FIG. 6;

FIG. 11 is a partially cut-off perspective view of the typefont wheel shown in FIG. 10;

FIG. 12 is a timing chart of the signals for driving the typefont wheel shown in FIG. 11;

DETAILED DESCRIPTION OF THE PREFERRED EMBODIMENTS

Although the typefont wheel is satisfactorily usable in a printer of the flying hammer type in which the printing paper is externally pressed against the typefont wheel, it is more advantageously applicable to a small printer of the type in which an impact force is applied internally to the typefont wheel to perform printing. For this reason, in the following there will be at first given an explanation on the printer of the latter kind.

Figure 1:
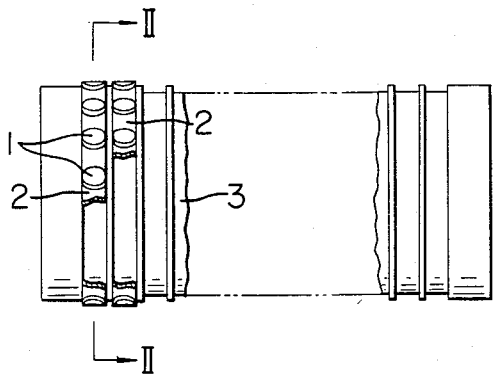
FIG. 1 PRIOR ART
FIG. 1 is a schematic elevation view of a typefont wheel employed in the conventional compact printer.
Figure 2:
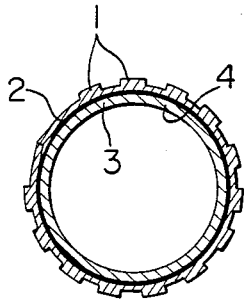
FIG. 2 PRIOR ART
FIG. 2 is a cross-sectional view along the line II—II in FIG. 1.
Figure 3:
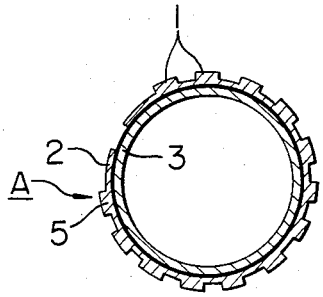
FIG. 3 PRIOR ART
FIG. 3 is a cross-sectional view similar to FIG. 2 but with aberrated typefont.
Figure 4:
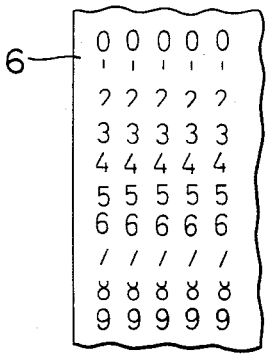
FIG. 4 PRIOR ART
FIG. 4 is a partial plan view showing an undesirable example of the printed characters obtained by the typefont wheel shown in FIG. 3.
Figure 5:
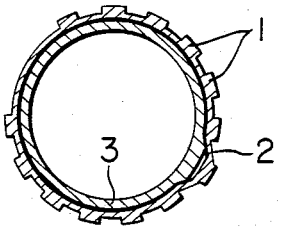
FIG. 5 PRIOR ART
FIG. 5 is a cross-sectional view similar to FIG. 2 but with a slack typefont belt.
Figure 6:
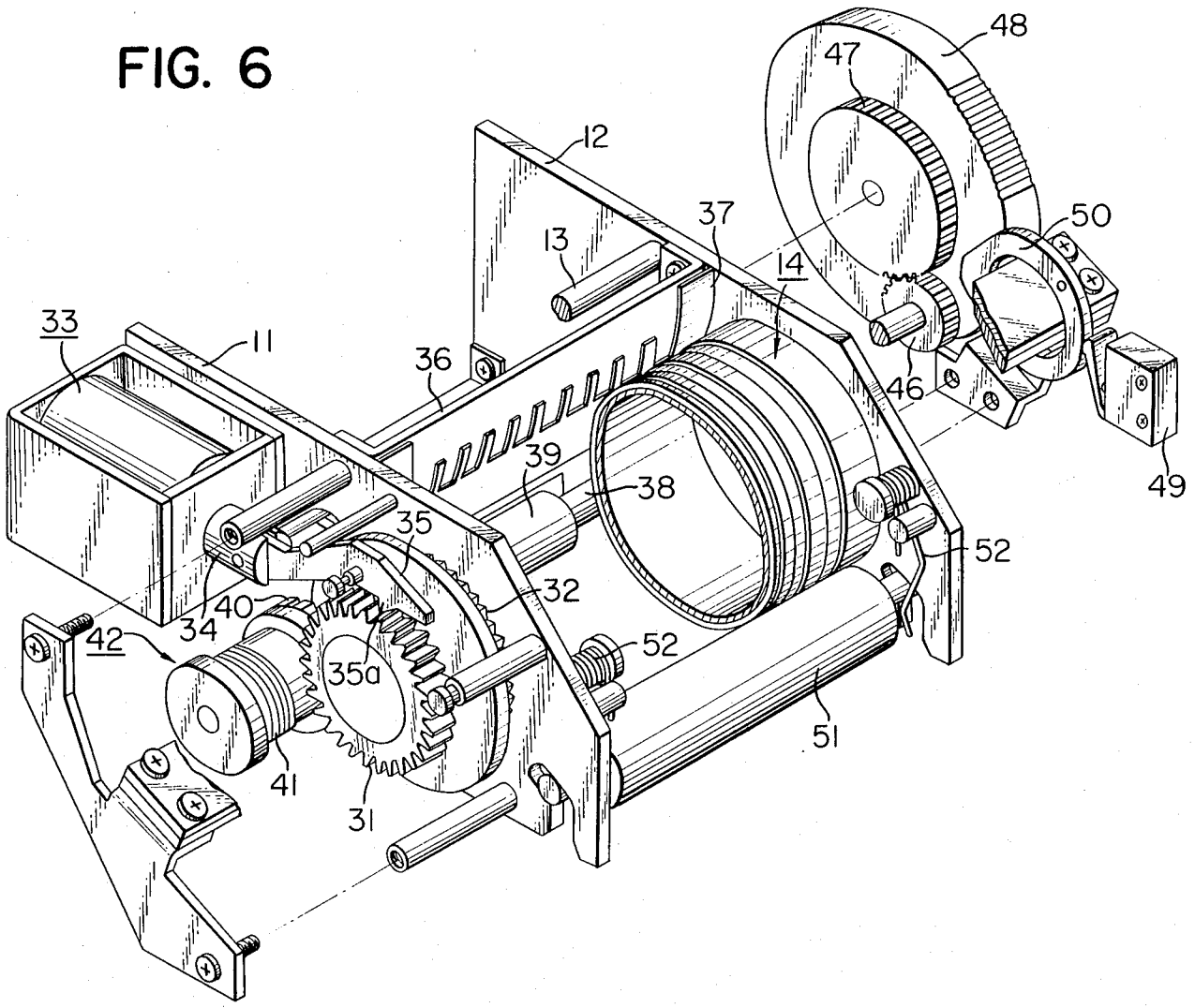
Figure 7:
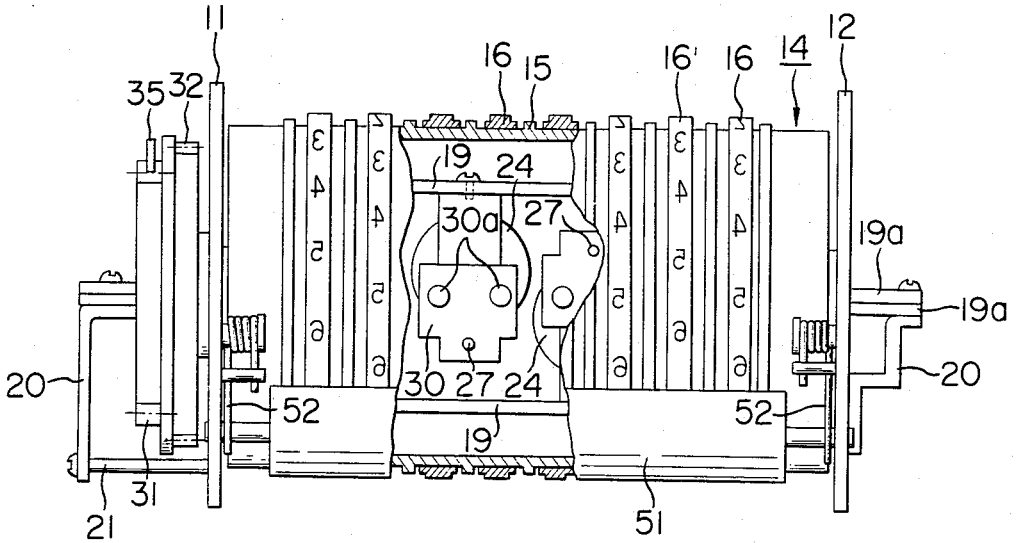

FIGS. 6 to 16 illustrate a small printer in which typefont impact means is provided inside the typefont wheel, wherein FIG. 6 shows a magnified view of the printing mechanism thereof. Said printing mechanism is constructed between a pair of side plates 11, 12, and the constituting parts of said mechanism are positioned in a parallel manner for example by a rod 13 etc. between said side plates 11, 12.

Between said side plates there is rotatably supported a typefont wheel 14 which is for example composed, as shown in FIGS. 7 to 10, of a cylindrical support 15 made of a hard synthetic resin and typefont belts 16, said support 15 being provided with annular grooves 15*a* therein having small apertures 15*b* at regular intervals. Said grooves 15*b* in a particular groove 15*a* are respectively so positioned as to be in the center of those in the neighboring grooves 15*a*, such zigzag or stepwise arrangement being hereinafter referred to as staggered arrangement.

Said typefont belt 16 is for example made of ethylene-propylene rubber, fluorinated rubber, neoprene rubber, acryl rubber, chloroprene rubber, chlorosulfonated polyethylene, styrene-butadiene rubber, urethane rubber, NBR, silicone rubber or other synthetic resin such as polyurethane and molded in a ring or a belt which can be fitted in a ring-shape in said groove 15*a* of the support 15. Each typefont belt 16 is provided on the external face thereof with printing types 16*a* at a pitch which is the same as or slightly smaller than the interval of said apertures 15*b* and on the internal face thereof with projections 16*b* respectively corresponding to said printing types 16*a*, said types and projections being integral with said belt 16. Said projections 16*b* are slidably fitted in said apertures 15*b* of the support 15. Consequently the printing types 16*a* of the typefont belts 16 are mounted in staggered arrangement between the neighboring belts.

The typefont wheel 14 of the above-explained structure is provided at the both ends thereof with annular end plates 17, in the center of which externally protruding are bosses 17*a* for rotatably supporting said typefont wheel on said side plates 11, 12.

Figure 8:
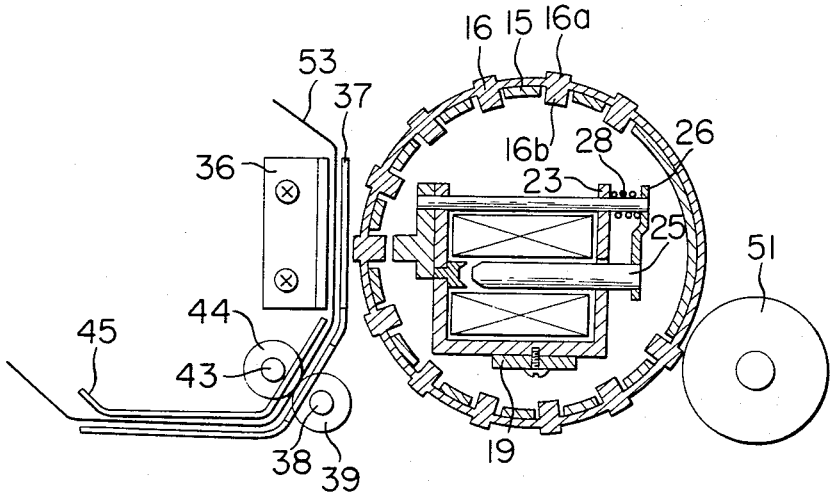
Figure 9:
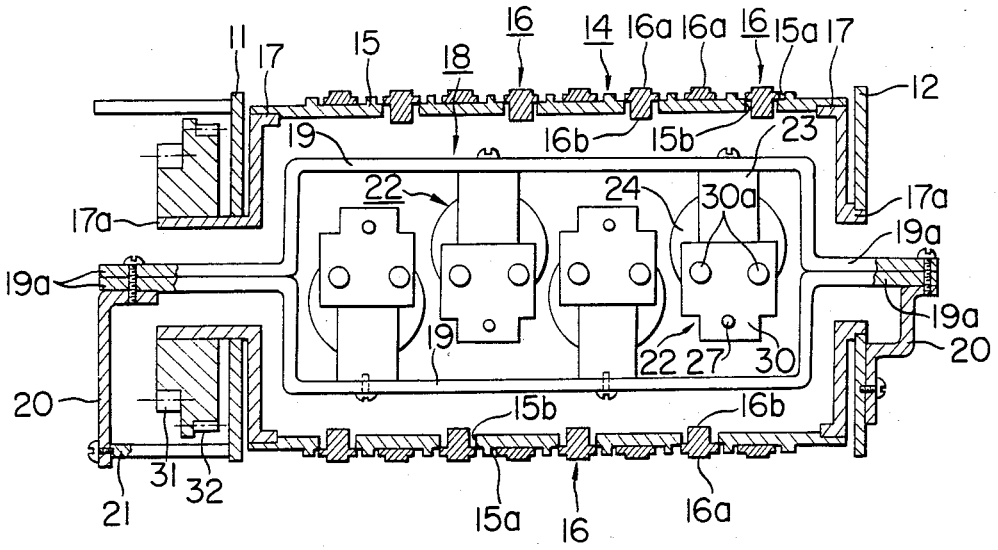
Figure 10:
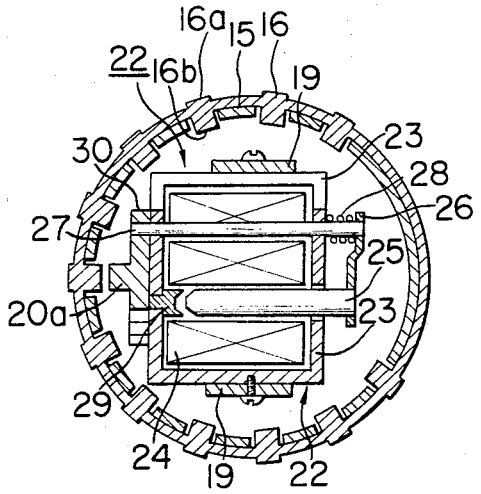

As shown in FIG. 8, a hammer assembly 18 is accommodated inside said typefont wheel or drum 14. Said hammer assembly 18 is principally assembled in vertically symmetrical support frames 19, 19 respectively provided at both ends thereof with bent portions 19*a* which are mutually superposed and secured, as shown in FIG. 9, by a screw to brackets 20 fixed on said side plates 11, 12. One of said brackets 20 is fixed to the side plate 11 through a rod 21. Said bent portions 19*a* are mounted in a position on the axis of said typefont wheel 14.

On said support frames 19, 19 there are mounted plungers 22 by means of square U-shaped yokes 23 and with alternating mounting arrangements. Each plunger 22 is positioned for two typefont belts 16. In said yoke 23 there is provided a tubular coil 24 in the center of which a movable core 25 is slidably fitted. The rear end of said movable core 25 is attached to an end of a bracket 26, of which the other end is fixed to the rear end of a guide rod 27 slidably supported parallel to said movable core 25 on the yoke 23. Between said bracket 26 and the lateral face of the yoke 23 there is provided a coil spring 28 for biasing the bracket 26 away from said lateral face. Also opposed to said movable core 25, there is mounted a fixed core 29 on said yoke 23.

Figure 11:
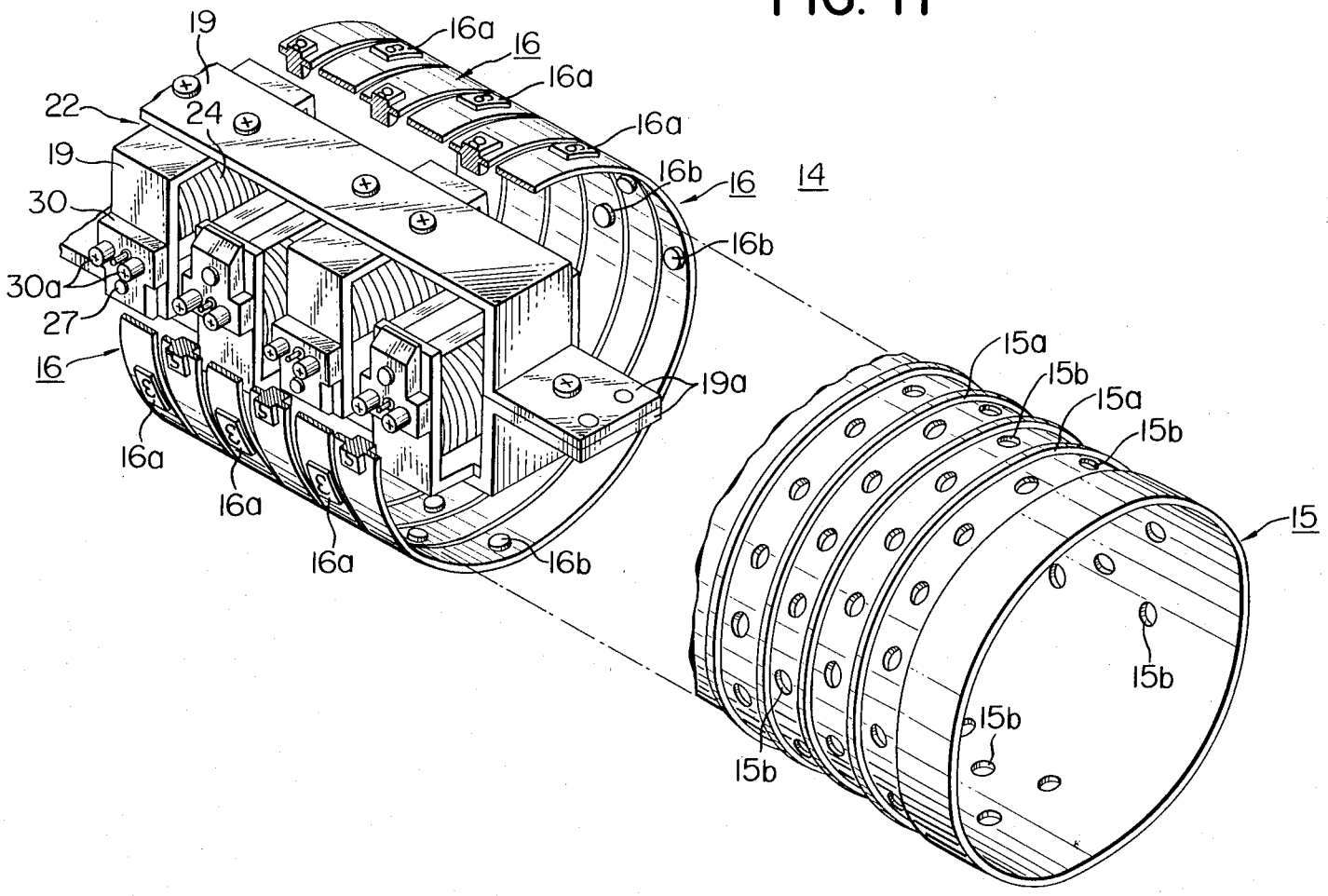

On the other end of said guide rod 27 fixed is a plate-shaped hammer 30 with an externally protruding impact boss 30*a*. As shown in FIGS. 9 and 11, these impact bosses 30*a* are arranged two by two along a generatrix parallel to the axis of the support 15, every two bosses being arranged corresponding to two typefont belts to hit the projections 16*b* thereof. Thus upon energization of the coil 24 for attracting the movable core 25 toward the fixed core 29 to cause protruding motion of the hammer 30, the impact bosses 30*a* hit only one projection 16*b* in two typefont belts 16 because of the staggered arrangement of said projections 16*b*. Stated differently it is rendered possible in this manner to utilize one plunger for two typefont belts thereby enabling a high-density arrangement of the components within a limited space.

The boss 17*a* of an end plate 17 of the support 15 is provided, outside the side plate 11, with gears 31, 32 as shown in FIG. 6. The gear 31 for driving the typefont wheel 14 is driven by a plunger 33 fixed outside said side plate 11. An end of a movable core 34 of said plunger 33 is articulated with an end of a lever 35, which is provided, at a lower face in the vicinity of the free end thereof, with a protruding ratchet 35*a* engaging with said gear 31.

Along and at a determined distance from said typefont wheel 14 there is provided a platen 36 transversally across said side plates 11, 12, said platen 36 having in front thereof a toothed paper guide 37 for guiding the printing paper and preventing ink stain formation thereon.

Between and below said platen 36 and typefont wheel 14 there is provided, parallel thereto and between the side plates 11, 12, a shaft 38 supporting a rubber roller 39 for advancing the printing paper. An end of said shaft 38 extends through the side plate 11 and supports a gear 40 engaging with said gear 32 having a recessed portion thereon. Because of the presence of said recessed portion the gear 40 is not driven for a determined period to interrupt the rotation of said rubber roller 39 and thus the advancement of the printing paper, during which the printing operation is effected. Outside said gear 40 there is provided a one-directional clutch 42 having a coil spring 41. In contact with said rubber roller 39 there is provided a pinch roller 44 rotatably supported on a shaft 43. 45 indicates an upper plate guide.

The shaft 38 is provided, on the other end thereof, with a gear 46 engaging with a gear 47 which has an integral manual paper feed knob 48.

49 is a signal detector fixed on the external face of the side plate 12 and adapted to generate signals by a cam 50 integrally rotating with said typefont wheel 14.

At a side of the typefont wheel 14 opposed to said platen 36 an ink roller 51 is rotatably supported between the side plates 11, 12 and constantly biased toward the type-font wheel 14 by means of a torsion spring 52.

Now there will be given an explanation on the function of the small printer explained above.

Prior to printing plunger 33 attracts the lever 35 in response to the pulse signals supplied thereto to step advance the gear 31 by means of the ratchet 35*a*, thus rotating the typefont wheel 14 by determined angles anticlockwise when seen in FIG. 6. When the typefont wheel is stopped in this state, and in response to character print instruction signals supplied from an unrepresented control circuit, the coil 24 of the selected plunger 22 is energized to attract the movable core 25 against the function of the spring 28 thereby advancing the hammer 30 by the guide rod 27, whereby the impact boss 30*a* hits the projection 16*b* of the selected typefont belt 16 thus impacting the printing paper 53 against the platen 36 to perform printing. In such function the elastic typefont belt 16 made for example of urethane rubber, NBR or silicone rubber is extended to ensure firm printing.

During the above-explained printing operation, the gear 40 is positioned in the recessed portion of the gear 32, so that the printing paper is not advanced.

Upon completion of the determined printing operation and upon one full turn of the gear 31, the gears 40 and 32 again engage to rotate the rubber roller 39 clockwise, whereby the printing paper 53 supported between said roller 39 and the pinch roller 44 is advanced upwards by a determined length to await the succeeding print demand signal.

Figure 12:
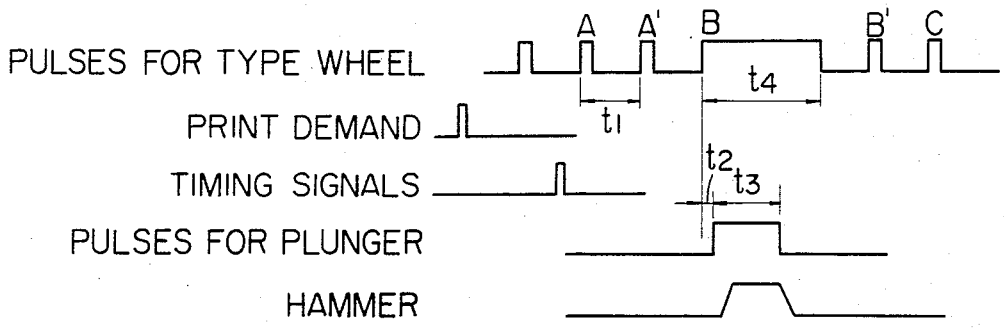

Referring to FIG. 12 showing a timing chart of the printing operation, in case of a print demand signal for a character "B", the typefont wheel rotating pulses supplied to the plunger 33 for step rotating the typefont wheel 14 by a determined angle is held for a period t4 when the typefont wheel reaches a position for printing the character "B". The typefont wheel 14 is brought to a complete stop after a stabilizing time t2 from the start of said signal holding. After said stopping is reached, a pulse signal is supplied to the plunger 22 during a period t3 to effect printing by means of the hammer 30. Such holding of the typefont wheel at the printing prevents the aberrated printing as observable in the conventional flying hammer method.

Because of the foregoing structure, the small printer of the present invention provides various advantages.

The first advantage lies in a fact that the mechanism accommodating the hammer assembly inside the typefont wheel which drives the hammers with a single plunger enables compactization of the printer with a high-density parts arrangement.

The second advantage lies in the significantly lowered printing noise because of the typefont belt being internally hit by the hammer to press the types against the paper, in comparison with the conventional printing system in which the printing paper is pressed against the types by an external hammer.

The third advantage lies in the lowered energy consumption of the plungers because of the use of an elastic typefont belt, whereby the plungers can be made smaller to allow further compactization of the apparatus.

The fourth advantage lies in the significantly reduced number of component parts in comparison with the conventional printers of typefont wheel select type, enabling a lower cost, a smaller dimension and a lower power consumption.

Figure 13:
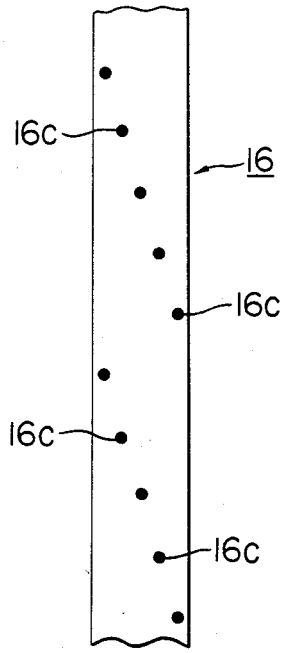
FIGS. 13 and 14 are partial magnified plan views of other examples of the typefont belt.
Figure 14:
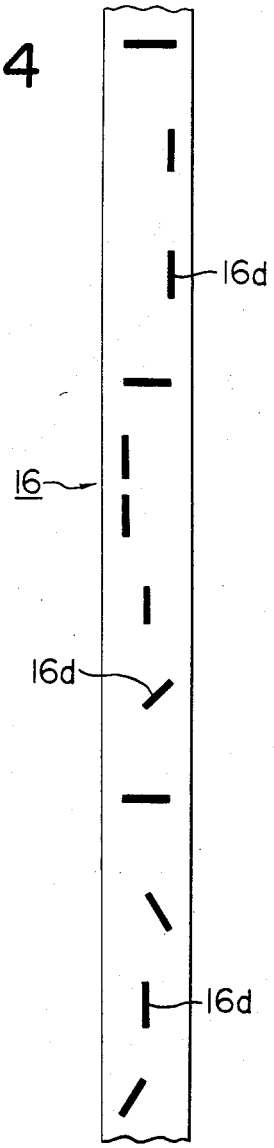

FIGS. 13 and 14 show other embodiment of the typefont belt. In FIG. 13 the belt is provided with dots 16*c* arranged at a determined pitch, and such belt can also be utilized in a dot printer. In FIG. 14, the belt 16 is provided with segments 16*d* in a determined arrangement, and such belt 16 is usable in a segment printer.

The solenoid plunger employed in the foregoing embodiment as the hammer driving means may be replaced by mechanical drives such as by cams or levers. Also the printer of the present invention may be realized as a serial printer instead of the parallel printer.

Figure 15:
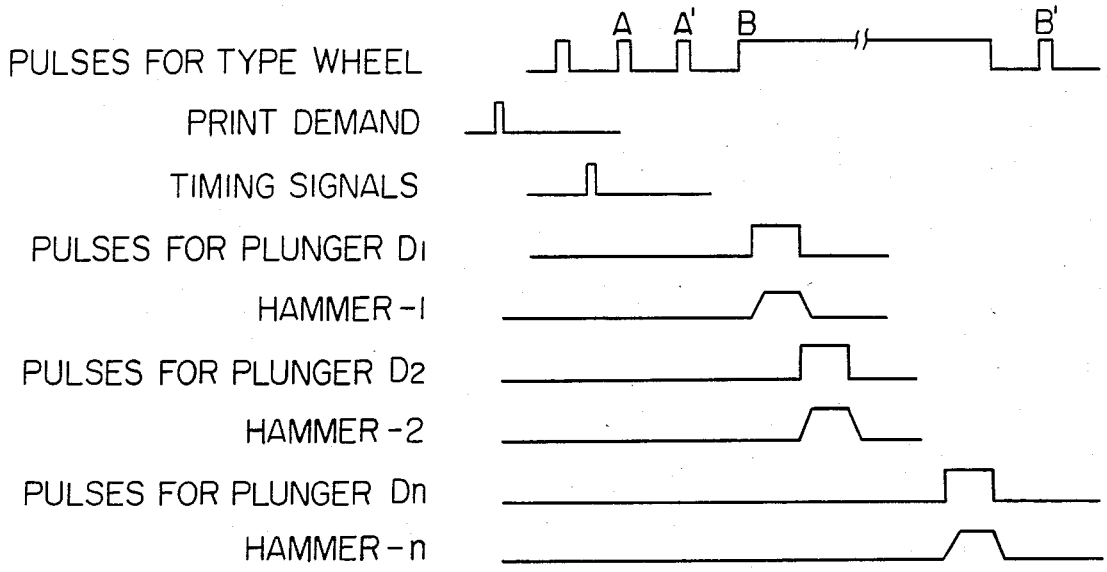
FIG. 15 is a timing chart showing the drive system.

FIG. 15 shows a timing chart illustrating a case of printing a same character over plural digits, wherein the typefont wheel is maintained in a position for printing said character ("B" in this case) while the plungers 22 are supplied with drive pulses D1, D2, . . . , Dn is succession in order to prevent elevated power consumption caused by simultaneous function of the plungers.

Now there will be given an explanation on the preferred embodiments of the typefont wheel adapted for use in the small printer of the inside hammer structure explained in the foregoing, while making reference to FIGS. 16 to 28.

Figure 16:
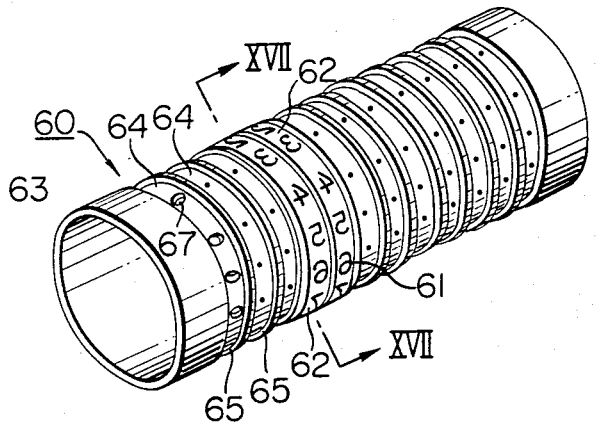
FIG. 16 is a perspective view showing an embodiment of the typefont wheel for the compact printer of the present invention.
Figure 17:
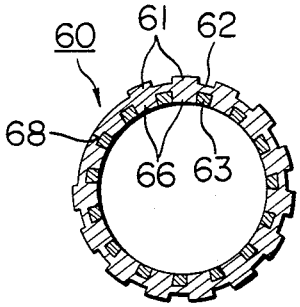
FIG. 17 is a cross-sectional view along the line XVII—XVII in FIG. 16.

In an embodiment shown in FIGS. 16 and 17, the typefont wheel 60 is composed of typefont belt 62 composed of an elastic material and each having printing types 61 representing plural numerals, symbols etc., and a cylindrical support 63 around which said typefont belts are mounted.

Said support 63 is provided with grooves 64 for fitting said belts and plural ribs 65 defining said grooves.

Also the typefont belt 62 is provided, on a face thereof opposed to said types 61, plural positioning projections 66, which should preferably provided over the entire length of said belt and are therefore formed also in the portion of the belt in which said types are not present.

On the other hand each groove 64 of the support 63 is provided with plural corresponding apertures 67 for defining the positions and pitch of said types 61 and adapted to be fitted with said positioning projections 66. The distance between said corresponding apertures 67 is slightly larger than the distance between said positioning projections 66, so that, when said typefont belt 62 is mounted on the support 63, said projections respectively engage with said apertures to apply a substantially uniform tension to the typefont belt 62.

Each typefont belt 62 is composed of an independent sheet which is mounted on the support 63 by adhering the end portions with an adhesive material 68 or by heat fusion.

Figure 18:
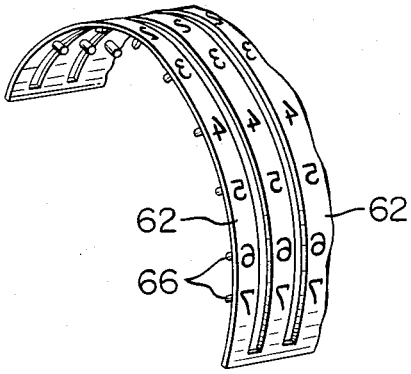
FIG. 18 is a partial perspective view of an example of the typefont belt for use in the typefont wheel shown in FIG. 16.

It is also possible, as shown in FIG. 18, to arrange mutually separated plural typefont belts 62 in a sheet form, in which said belts are mutually connected at the end portions thereof. Also in such case, the mutually connected end portions are adhered with an adhesive material.

Figure 19:
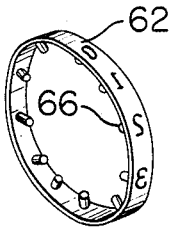
FIG. 19 is a perspective view of another example of the typefont belt.

Furthermore the typefont belt 62 may be formed as an endless ring as shown in FIG. 19. In this case the belt is fitted on the support 63 under an extended state, so that fixation with an adhesive material becomes unnecessary.

Said typefont belt 62 is formed of an easily formable elastic material generally having a sufficient affinity to the printing ink, such as polyurethane rubber, silicone rubber, chloroprene rubber, styrene-butadiene rubber, chlorosulfonated polyethylene, nitrile rubber, butyl rubber, ethylene-propylene rubber, fluorinated rubber, neoprene rubber, acrylic rubber etc.

Also the support 63 is made of strong and light material such as plastic or aluminum.

In the assembly of said typefont wheel 60, the typefont belt 62 is wound in extended state around the support 63 so as to fit the projections 66 into the corresponding apertures 67. As the result the typefont belt 62 is maintained under tension, and the positions and pitch of the printing types 61 are exactly defined. For this reason the defective print or slack in the belt can be prevented even if the positions of the types are somewhat inexact.

Figure 20:
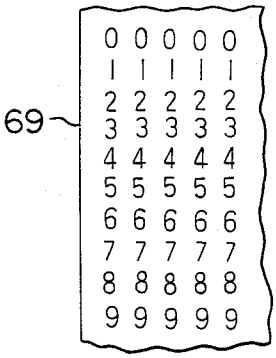
FIG. 20 is a partial plan view showing an example of normal printing obtained by the typefont wheel shown in FIG. 16.

In this manner the typefont wheel of the present invention provides normal and exact printed characters on a paper 69, as shown in FIG. 20.

In the embodiment shown in FIGS. 16 to 18, the sheet-shaped typefont belt 62 is fixed with the adhesive material, used for mass production. In the following shown therefore is another embodiment allowing an easy working without the use of such adhesive material.

Figure 21:
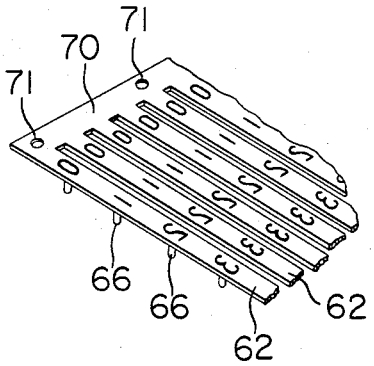
FIG. 21 is a partial perspective view of typefont belt in another embodiment of the present invention.
Figure 22:
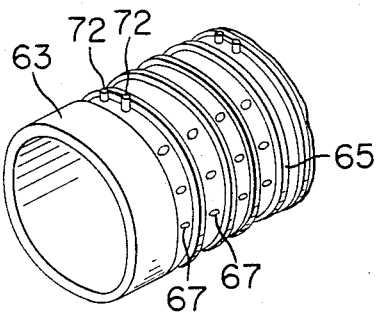
FIG. 22 is a partial perspective view of a support for mounting the typefont belt shown in FIG. 21.
Figure 23:
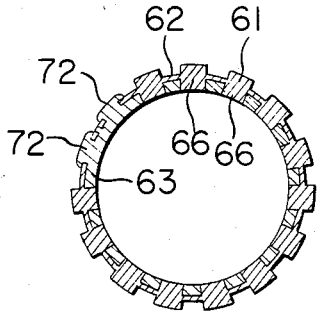
FIG. 23 is a lateral cross-sectional view of the typefont belt in FIG. 21 combined with the support in FIG. 22.

In this embodiment, a sheet composed of plural typefont belts 62 is provided, in the end connecting portions 70 thereof, with fixing holes 71 as shown in FIG. 21, which are fitted on corresponding fixing bosses 72 provided on the support 63 as shown in FIG. 22. After said fitting said bosses 72 are caulked to secure the typefont belts 62 in position. Naturally similar fixation is possible also in case of independent typefont belts 62.

Figure 24:
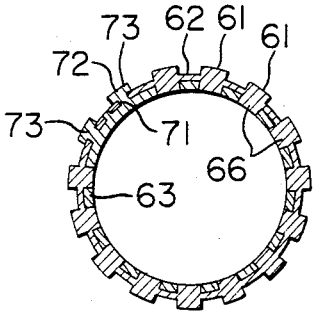
FIG. 24 is a lateral cross-sectional view showing a variation of FIG. 23.

Also FIG. 24 shows an embodiment in which the fixing holes 71 of the typefont belt 62 are fitted on fixing bosses 72 having already enlarged head portions 73.

Figure 25:
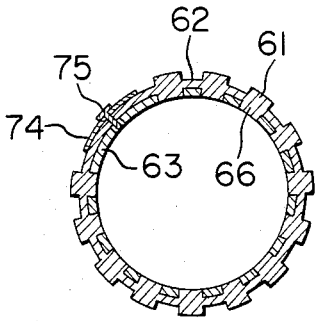
FIG. 25 is a lateral cross-sectional view showing another variation of FIG. 23.

FIG. 25 shows still another embodiment of fixing the typefont belt 62 to the support by pressing the end portions of the typefont belt 62 with a plate member 74 which is fixed with a screw 75 to the support 63.

Figure 26:
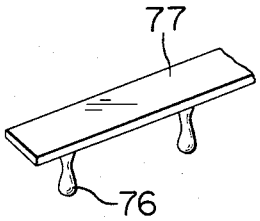
FIG. 26 is a partial perspective view of a member for mounting the typefont belt on the support.
Figure 27:
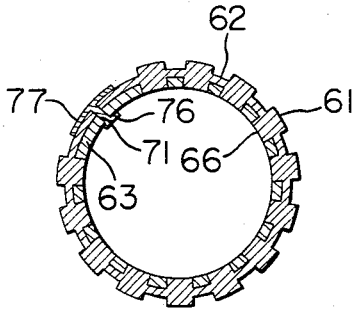
FIG. 27 is a lateral cross-sectional view showing the typefont wheel of the present invention utilizing the mounting member shown in FIG. 26.

Also said plate member 74 may be replaced by a fixing plate member 77, as shown in FIG. 26, having integral elastic projections 76 which are pressed into fixing holes 71 of the support 63 as shown in FIG. 27 to fix the end portions of the typefont belt 62 to the support 63.

Figure 28:
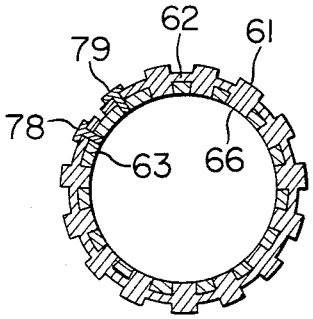
FIG. 28 is a lateral cross-sectional view showing a variation of FIG. 27.

Furthermore, as shown in FIG. 28, the end portions of the typefont belt 62 can be respectively fixed by separate pins 78, 79 to the support 63.

The typefont wheel of the present invention is best suited, because of the tensioned state of the typefont belt on the support, for use in a printer in which, as shown in FIGS. 6 to 11, the impact force to the printing types is given to said positioning projections 61 from the interior of the typefont wheel, because such internal impact causes an outward extension of the typefont belt creating tension which ensures rapid and exact returning of the belt to the original position, thus increasing the printing speed. However, the typefont wheel of the present invention, also results in improved precision in the positioning of the printing types, and is also effectively employed in the printer of the flying hammer system.

As explained in the foregoing, the present invention prevents the drawback of slack in the belt since the typefont belt is maintained under tension on the support. Also it is possible to use a typefont belt showing certain inaccuracy in the positions of the printing types, since the position of the typefont belt or printing types 61 is exactly determined by the position of the apertures provided on the support. Furthermore, as it is easy to prepare the support with a high precision and there is no difficulty in the mounting of the typefont belt thereon as in the prior method with the adhesive material, the typefont wheel of the present invention easily allows exact positioning of the types, is easily manufacturable and is suited for mass production.

Also where the types are hit by hammers from the interior of the typefont wheel, although the hammer leaves the printing type immediately after such hitting, the increased tension in the typefont belt advantageously ensures rapid and secure returning of the printing type to the original position.

In the foregoing embodiments the printing types and the projections to be hit by the hammer are integrally made of the same material as the typefont belt itself, but such structure may result in a deformation in the printing type when the belt is hit by the hammer. In such case preferred is the use, as shown in FIGS. 29 to 31, of a structure composed of an elastic member constituting the typefont belt and separate printing types.

Figure 29:
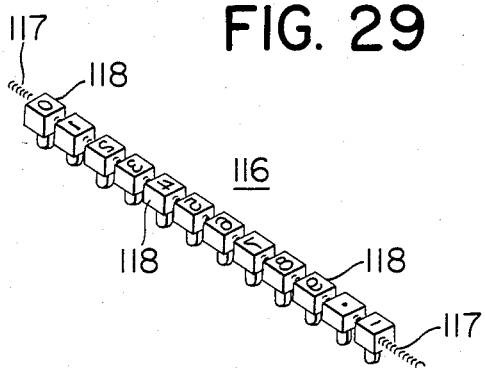
FIG. 29 is a perspective view of another embodiment of the typefont belt.
Figure 30:
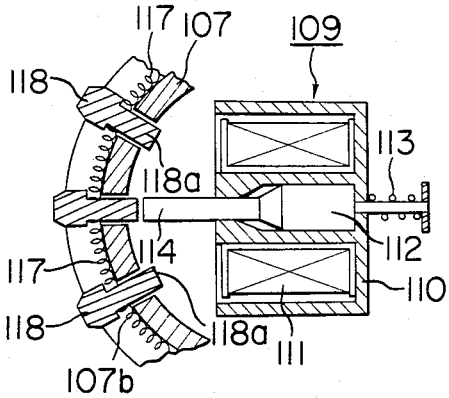
FIGS. 30 and 31 are magnified cross-sectional views showing the function of the typefont belt.
Figure 31:
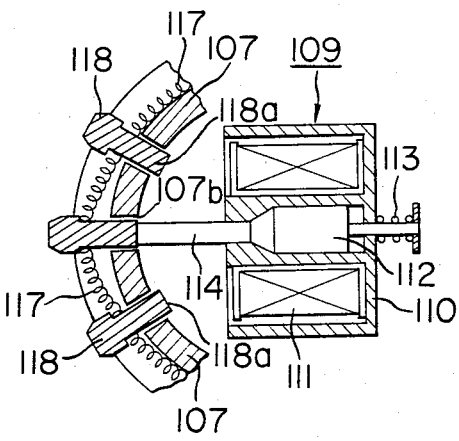

In FIGS. 29 to 31, the typefont belt 116 is composed of a coil spring 117 utilized as an example of the elastic member, on which type blocks 118 are mounted at determined intervals. Each printing type block 118 is provided at the rear face thereof with a projection **118*a* which is slidably fitted in a small aperture 107*b* of the support 107. As shown in the cross-sectional views in FIGS. 30 and 31, projection 118*a* penetrates through the type block 118** which is fixed on said spring for example with an adhesive material.

In the present embodiment, because of the above-explained structure, the type block 118, separate from the coil spring 117, is alone hit at the printing operation so that the deformation is limited to the coil spring 117 and does not affect the type block.

Figure 32:
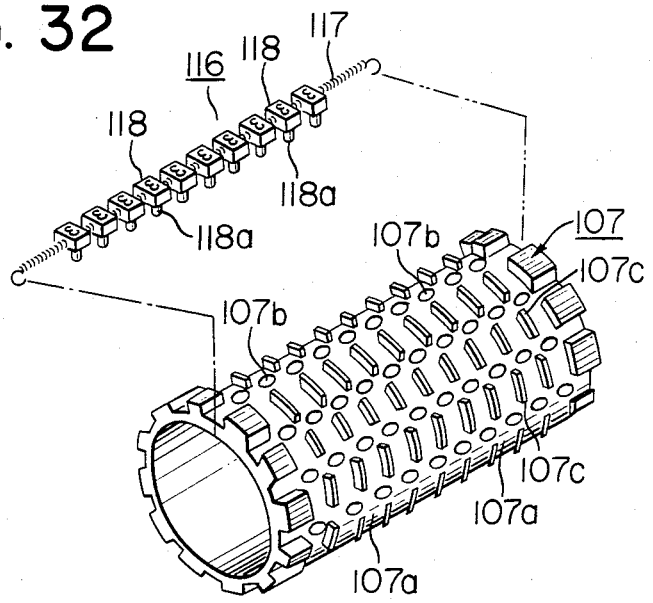
FIG. 32 is a perspective view showing another embodiment of the present invention.
Figure 33:
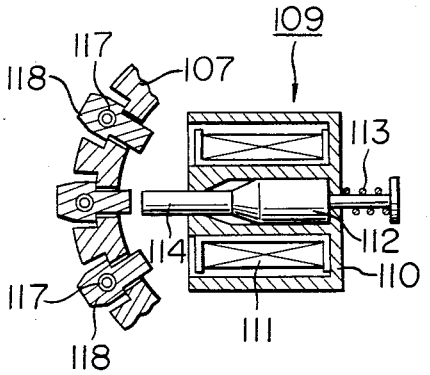
FIGS. 33 and 34 are magnified cross-sectional views showing the function of the typefont belt.
Figure 34:
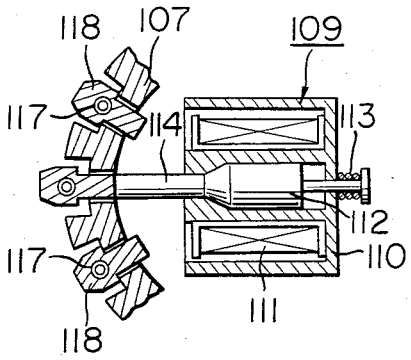

In the foregoing embodiment in which the coil spring 117 constituting the elastic member is arranged under tension in the peripheral direction of the support 107, the type block 118 may cause swaying in the vertical direction of the paper when it is hit by the hammer. In order to avoid such drawback there is recommended the use of the embodiment shown in FIGS. 32 to 34.

In said embodiment the coil spring 117 is arranged along the longitudinal direction of the support 107 and is provided thereon with type blocks 118 at determined intervals. In such structure the support 107 is modified in such a manner that the partitions 107*c* between the grooves 107*a* are divided at determined intervals to allow passage of said coil springs 117.

In this embodiment the coil spring 117 allows elastic deformation only in the longitudinal direction of the support 107 when the type block 118 is hit by the hammer 114, whereby the swaying motion of the type block in the vertical direction can be prevented.

Figure 35:
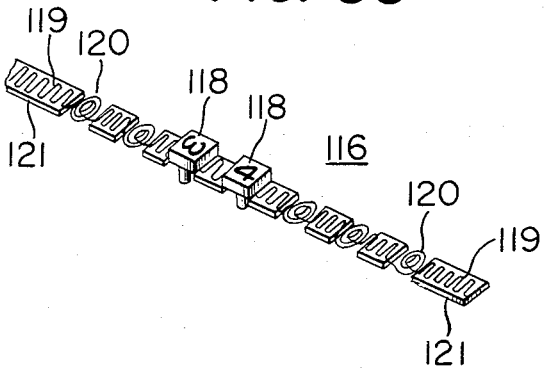
FIGS. 35 and 36 are a perspective view and a partial lateral view of another embodiment of the typefont belt.
Figure 36:
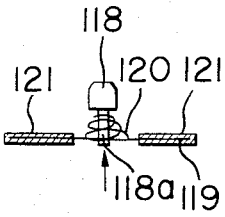

The above-mentioned coil spring 117, employed as the elastic member supporting the type blocks 118 in the embodiments shown in FIGS. 29 to 34, may also be replaced by a structure shown in FIGS. 35 and 36, wherein the typefont belt 116 is formed of a wire material so formed as to provide alternating meandering portions 119 and conical spiral portions 120 at regular intervals, said meandering portion 119 being molded in a plastic material in the form of a plate member while said conical spiral portion 120 serving to support the type block 118. Upon receipt of an impact by the hammer said conical spiral portion 120 becomes extended to achieve printing. The identical effect mentioned above can also be achieved by the use of this structure.

Figure 37:
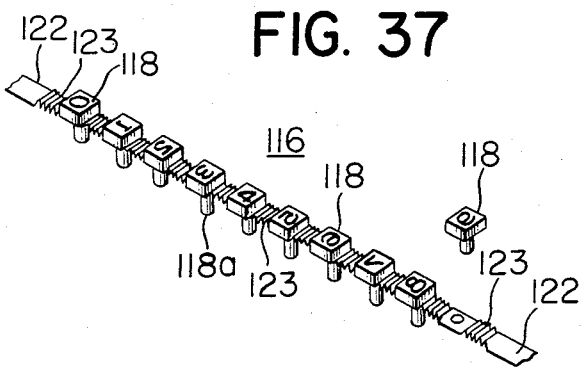
FIG. 37 is a perspective view of still another embodiment of the typefont belt.
Figure 38:
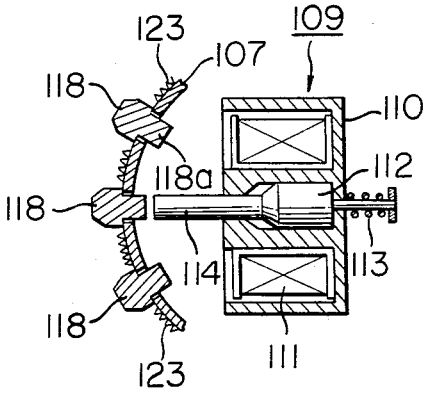
FIGS. 38 and 39 are magnified cross-sectional view showing the function of the typefont belt.
Figure 39:
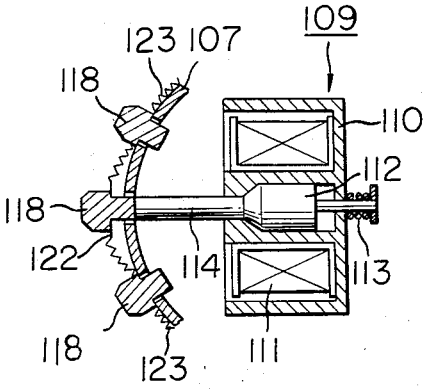

The elastic member composed of a wire material employed in the embodiments shown in FIGS. 29 to 36 may further be replaced by a thin belt 122 of an elastic material, which, as shown in FIGS. 37 to 39, is provided with expandable corrugated portions 123 at regular intervals, the type blocks being fixed on the uncorrugated portions.

Figure 40:
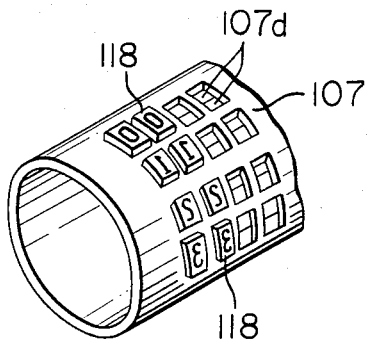
FIG. 40 is a perspective view of still another embodiment of the present invention.
Figure 41:
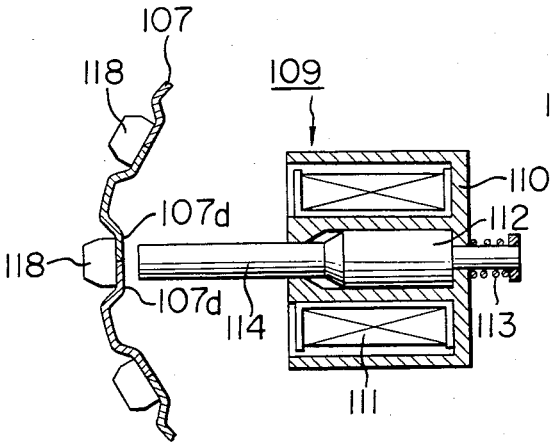
FIGS. 41 and 42 are magnified cross-sectional views showing the function of the typefont belt.
Figure 42:
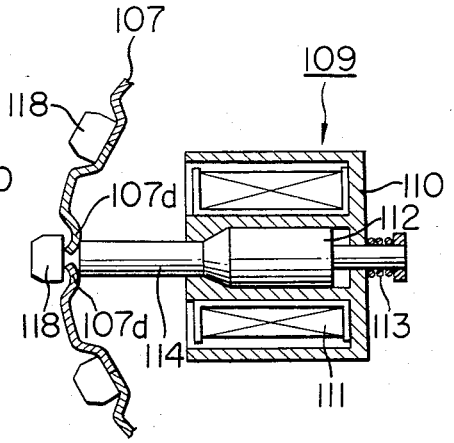

Furthermore, in contrast to the foregoing embodiments in which the typefont belt itself is endowed with elasticity by means of certain structure, there may be employed a structure shown in FIGS. 40 to 42, in which the support 107 itself is provided, along the periphery thereof and at regular intervals, with elastically deformable portions 107*d*, 107*d*, the type block 118 being fixed on the free ends of said deformable portions. Such a structure not only provides the same effect as explained before but also reduces the number of component parts, thus enabling an integral molding of the typefont wheel with reduced production cost.

As explained in the foregoing, the typefont wheel of the present invention, because of the use of a structure in which the printing types constituting a part of the typefont wheel are supported by an elastic member, provides the advantages of a reduced printing noise, a reduced printing energy, thus enabling the use of smaller plungers for hammer driving and significant size reduction of the printer.

Figure 43:
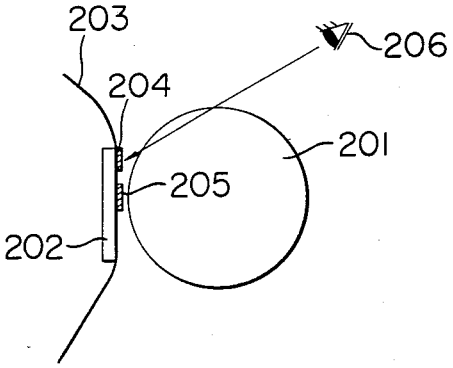
FIGS. 43 and 44 are lateral views illustrating different conventional mechanisms.

FIG. 43 shows a conventional printer of this kind in a schematic cross-sectional view, in which a typefont wheel 201 accommodating the aforementioned hammer assembly therein is positioned in facing relation to a platen 202 along which a printing paper 203 is advanced. On said paper 203, 204 indicates the position of an already printer character while 205 indicates the position of a character to be printed next. In such arrangement the typefont wheel 201, if having a large diameter, shields the already printed character from the eye 206 of the operator, thus preventing the operator from confirming the printed characters. This step of confirmation in fact provides an important sense of security to the operator, and secure printing operation is rendered impossible without such confirmation.

Figure 44:
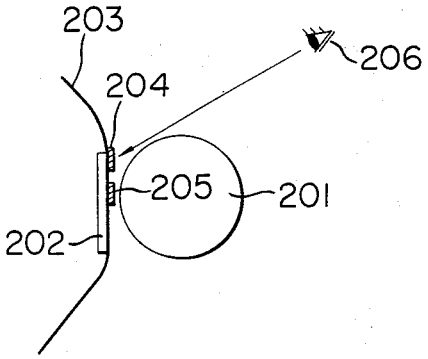

In order to avoid such drawback there has been proposed, as shown in FIG. 44, to reduce the diameter of the typefont wheel 201 and also to reduce the distance between said typefont wheel 201 and the platen 202. Although such structure certainly facilitates the confirmation of the printed characters, the reduction in diameter of the typefont wheel 201 has a limitation and is not applicable to certain compact printers, particularly those with the hammer assembly located inside the typefont wheel.

Figure 45A:
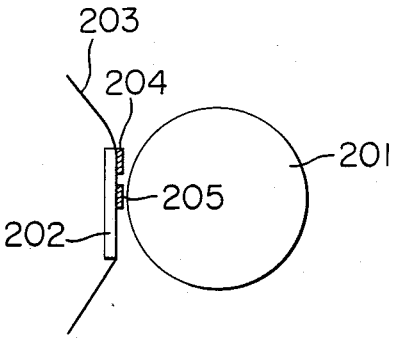
FIGS. 45A–45C are lateral views illustrating the function of other conventional mechanisms.
Figure 45B:
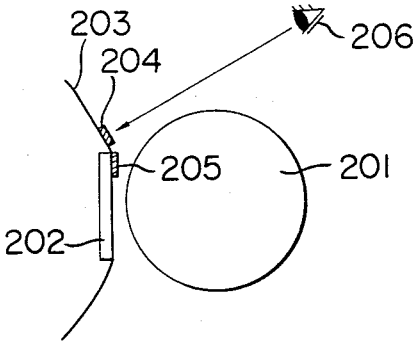
Figure 45C:
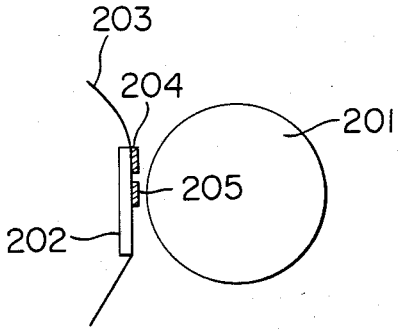
Figure 46:
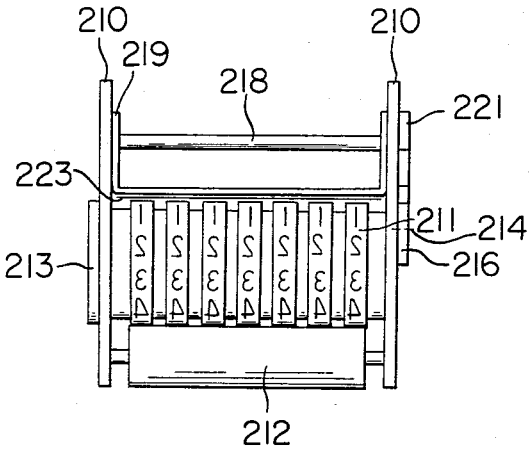
FIG. 46 is a plan view of an embodiment of the present invention.

For this reason there has also been proposed a method, as shown in FIGS. 45A to 45C, of utilizing the typefont wheel 201 of a large diameter for printing, then displacing the paper 203 upwards as shown in FIG. 45B to enable visual confirmation of the printed characters 204 by the eye 206 of the operator, and, at the successive printing, again lowering the paper 203 as shown in FIG. 45C so as that the next print portion 205 is brought to facing relation to the typefont wheel 201. Although such method allows confirmation of the printed characters even with the typefont wheel of a large diameter, it is not desirable in consideration of the complexity and cost of the apparatus as there is required a mechanism for advancing and reversing the printing paper.

Reference is now made to FIGS. 46 to 50 showing another embodiment of the present invention, in which support plates 210, 210 rotatably support therebetween a typefont wheel 211 and an ink roller 212 maintained in contact with said typefont wheel. Outside a support plate 210 there is provided a partially toothed gear 213 coaxial with the typefont wheel 211.

Figure 48:
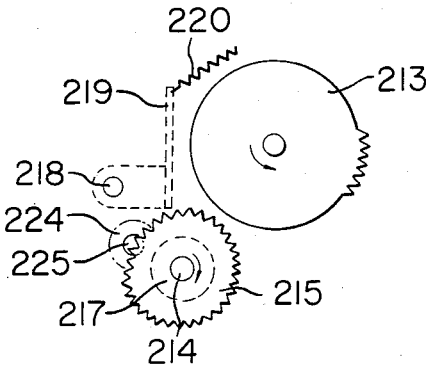
FIG. 48 is a lateral view of the embodiment shown in FIG. 46 seen from left.
Figure 49:
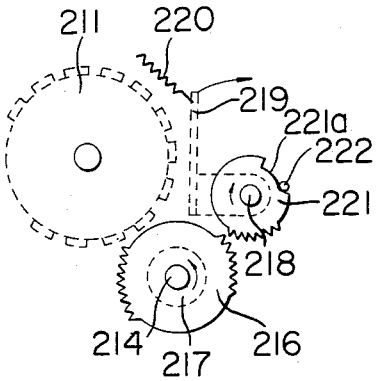
FIG. 49 is a lateral view seen from right and showing the function of the embodiment shown in FIG. 46.

Also between said support plates 210, 210 rotatably supported is a shaft 214 which is provided on an end thereof which a rubber roller gear 215 meshing with said partially toothed gear 213 as shown in FIG. 48 and on the other end thereof with a partially toothed gear 216 having teeth in the corresponding portions as shown in FIG. 49. A rubber roller 217 is fixed on said shaft 214 and between said partially toothed gears 215, 216.

Also between said support plates 210, 210 and parallel to the typefont wheel 211, there is rotatably provided a shaft 218, which supports, at the both ends thereof and between said support plates 210, 210, a platen 219 of a square U-shaped cross section. A return spring 220 is provided between the free end of said platen 219 and a fixed portion of the printer. Outside a support plate, the shaft 218 of said platen 219 has a partially toothed gear 221 having a recess 221*a* over a part of the periphery of a determined center angle, said recess 221*a* engaging with a stopper pin 222 mounted on a fixed part of the printer. 223 indicates a printing paper.

Said printing paper 223 is pinched and advanced between the rubber roller 217 and a pinch roller 224 having a shaft 225 and rotated in friction contact with said rubber roller 217.

In the following explained is the function of the above-explained embodiment.

When the typefont wheel 211 reached a determined position after a series of the printing operations, the partially toothed gear 213 meshes with the rubber roller gear 215 to rotate the rubber roller 217 and the pinch roller 224, whereby the printing paper 223 supported therebetween is advanced upwards by a determined distance.

Figure 50:
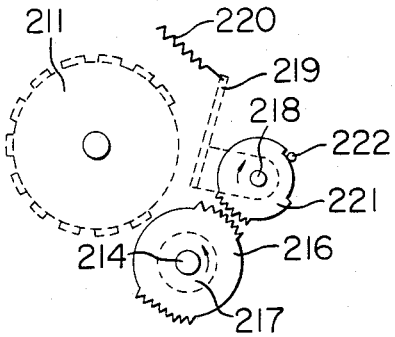
FIG. 50 is a magnified lateral view seen from right and showing the arrangement of the hammer and the platen.
Figure 51:
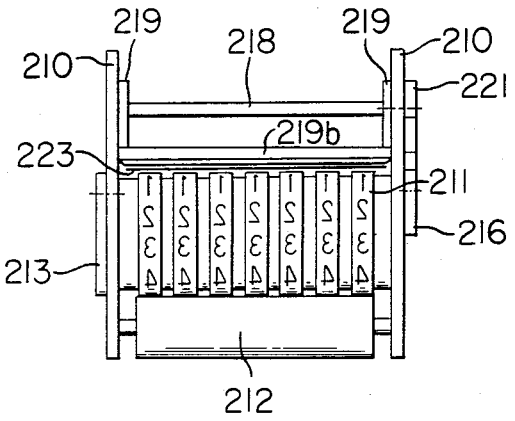
FIG. 51 is a plan view of still another embodiment of the present invention.
Figure 52:
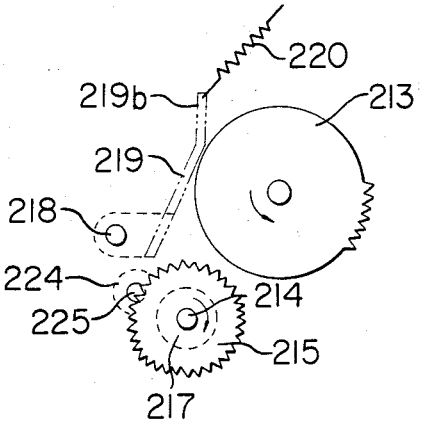
FIG. 52 is a lateral view seen from left of the embodiment shown in FIG. 51.
Figure 53:
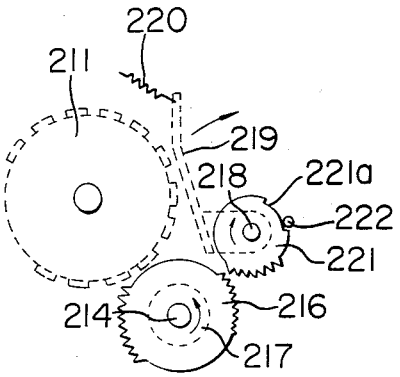
FIG. 53 is a lateral view seen from right of the embodiment shown in FIG. 51.

On the other hand the rotation of the rubber roller gear 215 causes the rotation of the partially toothed gear 216 mounted on the other end of the shaft 214, whereby it meshes with and causes the rotation of the partially toothed gear 221. Upon said rotation an end of said recess 221*a* comes into contact with the stopper pin 222, whereby the platen 219 is rotated clockwise, as shown in FIG. 50, about a shaft 218 against the tension of the spring 220, thus separating the platen 219 from the typefont wheel 211 by a determined angle.

Figure 47:
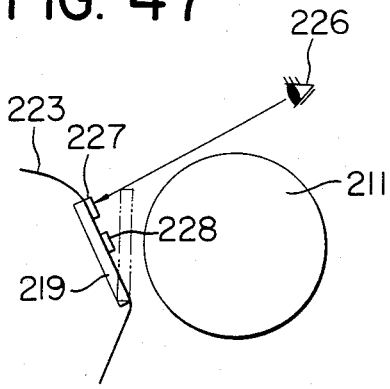
FIG. 47 is a lateral view of the embodiment shown in FIG. 46 seen from left.

As the result the printing paper 223 is also separated from the typefont wheel 211 as shown in FIG. 47, thus enabling visual confirmation the printed characters 227 by the eye 226 of the operator. 228 indicates the next print position. Upon termination of the meshing state between the partially toothed gears 216 and 221, the platen is reversed to the initial position by the tension of the spring 220, whereupon the gear 221 also returns to the original position.

As explained in the foregoing, the present embodiment functions to separate the platen together with the printing paper from the typefont wheel immediately after the printing, thus enabling confirmation of the printed characters even with the typefont wheel of a large diameter, by means of an easily realizable simple and inexpensive structure.

Although partially toothed gears are employed for separating the platen 219 from the typefont wheel 211 in the present embodiment, it will naturally be understood other mechanisms such as stepping motor or plunger may also be usable for the same purpose.

As explained in the foregoing, the present invention enables to rotate the platen, together with the printing paper thereon, in a direction away from the typefont wheel, thereby ensuring visual confirmation of the printed characters even when the typefont wheel employed has a large diameter.

Figure 54:
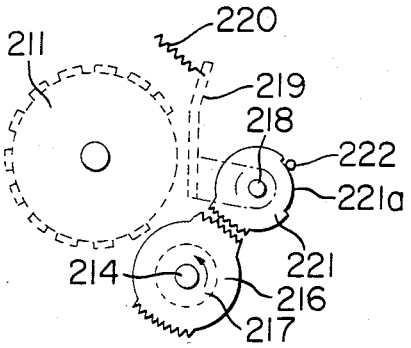
FIG. 54 is a lateral view illustrating the function of the embodiment shown in FIG. 53.
Figure 55:
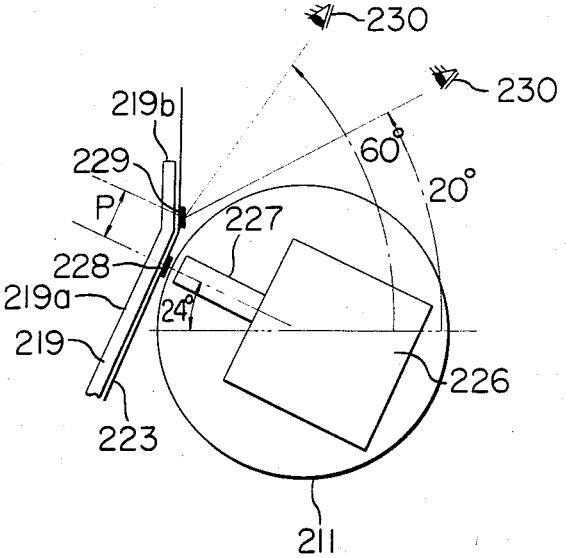
FIG. 55 is a cross-sectional view of the interior.

FIGS. 51–55 shows still another embodiment of the present invention, in which the typefont wheel 211 accommodates therein a plunger assembly 226 as shown in FIG. 55, having a plunger for every print digit or for every two print digits, the rod of said plunger constituting a hammer 227 which is mounted in a position inclined by a determined angle from the horizontal line. According to the experimental results obtained by the present inventors, said angle of inclination should preferably in a range of 10°–30°, particularly in the vicinity of 24°, in combination of typefont wheel diameter in a range of 20–30 mm, preferably in the vicinity of 25 mm.

Corresponding to the inclined axis of the hammer 227, the platen 219 is provided with a facing portion 219*a* perpendicular to said hammer axis. Thus the surface of said portion 219*a* facing the typefont wheel 211 is perpendicular to the axis of the hammer 227, with 228 indicating the print position corresponding to the hammer 227. Adjacent to said portion 219*a* there is formed a vertical portion 219*b* to ensure visibility of the printed characters. The position 229 of the characters printed immediately before is located at the lower end of said vertical portion 219*b*. The pitch P between said positions 228 and 229 is preferably selected in the vicinity of 4.4 mm in case the typefont wheel 211 has a diameter for example of ca. 25 mm.

The viewing angle of the operator at the printed characters is, though variable according to the position of the eye 230 and the diameter of the typefont wheel, generally said to be in a range of 20°–60° from the horizontal if in case the diameter of the typefont wheel is within the aforementioned range. Consequently the inclination angle of said hammer 227, the length and pitch P of said facing portion 219*a* are determined in relation to the diameter of the typefont wheel 211 and also to the above-mentioned viewing angle. Such platen structure as explained above allows the visual confirmation of the printed characters even when the typefont wheel is of a large diameter, as long as the eye is positioned above a certain level.

Now there will be explained the function of the embodiment explained above.

When the typefont wheel 211 reaches a certain position after certain printing operations, a partially toothed gear 213 meshes with a rubber roller gear 215 to rotate the rubber roller 217 and the pinch roller 224, thereby advancing upwards the printing paper 223 supported between said rollers by a determined distance.

Also the rotation of said rubber roller gear 215 causes the rotation of the partially toothed gear 216 provided at the other end of the shaft 214, thereby rotating the partially toothed gear 221 provided on one side of the platen 219. Upon said rotation an end of the recess 221*a* comes into contact with the stopper pin 222, thereby rotating the platen 219 clockwise as shown in FIG. 54 about the shaft 218 against the tension of the spring 229, thus separating the platen 219 from the typefont wheel 211 by a determined angle. As the result the printing paper 223 together with the platen 219 is separated from the typefont wheel 211 and directed towards the eye 230 of the operator, thus further facilitating the confirmation of the printed characters 229.

Upon termination of the meshing state of the partially toothed gears 216, and 221, the platen 219 is returned to the original state by means of the spring 220, and said gear 221 is also returned to the initial state.

As explained in the foregoing the present embodiment provides an upper print position which permits immediate confirmation of the printed characters even in case of the use of the typefont wheel of a large diameter as long as the eye is located within an angular range, and such confirmation is further facilitated by the rotation of the platen in a direction away from the typefont wheel.

More specifically the present embodiment, in which the axial direction of the hammer is inclined upwards by a determined angle from the horizon and the platen has a bent configuration in such a manner that the platen portion in the print position is perpendicular to said hammer, provides an upwardly displaced print position which allows easy visual confirmation of the printed characters even in the use of a typefont wheel of a large diameter, and said confirmation is further facilitated by the displacement of the platen in a direction away from the typefont wheel.

Figure 56:
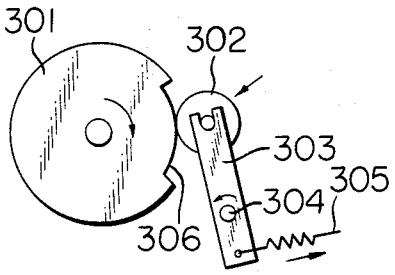
FIG. 56 PRIOR ART
FIG. 56 is a lateral view of a conventional printing apparatus.

Conventionally the printing apparatus of this kind comprises, as shown in FIG. 56, a rotatably supported typefont wheel 301, an ink roller 302 for applying printing ink onto said typefont wheel, a support member 303 for supporting the shaft thereof, and biasing means 305 such as spring pivoting said support member about a shaft 304 to constantly bias the ink roller 302 against the typefont wheel 301.

Generally in a printer having an intermittent paper feeding mechanism for performing paper feeding upon every full rotation of the typefont wheel, there is usually provided a space on said typefont wheel for the period of said paper feeding. For this purpose the typefont wheel 301 is provided with a recessed portion 306 without printing types in order to interrupt the printing and to prevent stain formation on the paper during such paper feeding.

However, in the conventional apparatus as shown in FIG. 56, the ink roller 302 comes into contact also with said recessed portion 306 to result in the drawbacks as will be explained in the following.

When the ink roller 302 proceeds from said recessed portion 306 to the normal portion through the shouldered part during the rotation of the typefont wheel 301, there is generated an impact force to give an undesirable effect such as load fluctuation on the drive source such as DC motor or stepping motor, eventually leading to the destruction thereof. Also the ink roller 302 itself is damaged by said impact.

The object of the present invention is to provide a printing apparatus of a structure not associated with such drawbacks and not creating the impact force between the typefont wheel and the ink roller.

Figure 57:
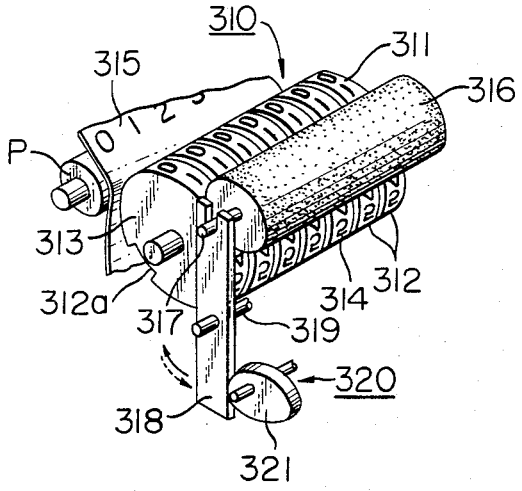
FIG. 57 is a schematic perspective view of an embodiment of the printing apparatus of the present invention.
Figure 58:
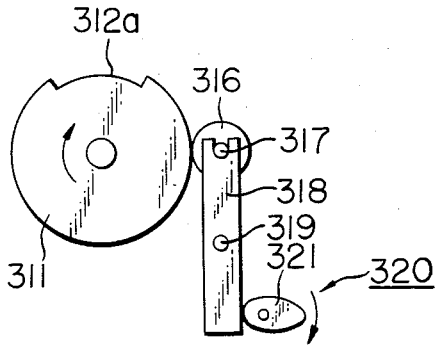
FIGS. 58 and 59 are lateral views illustrating the function thereof.

This embodiment will now be explained by FIGS. 57 to 59. In FIG. 57, the printing apparatus 310 is provided with a rotatably supported typefont wheel 311, which is composed of typefont belts 312 of a desired number and a cylindrical support 313 on which said belts are mounted.

On said typefont wheel 311, each of the typefont belts 312 is provided with a recessed portion 312*a* not having printing types 314 of numerals or symbols. Said recessed portion 312*a* are arranged along an axial line on said support 313, in a position thereof corresponding to a non-printing function mode such as paper feeding in the course of the rotation of the typefont wheel, in order to interrupt the printing operation and to avoid stain formation on the paper during such paper feeding. In general the paper feeding is effected once in every full rotation of the typefont wheel 311.

Inside said support 313 there is provided unrepresented impact means for giving an impact to said typefont belts 312 to drive the printing types 314 towards the printing paper 315, which is supported by a platen P provided in the vicinity of and parallel to the typefont wheel 311.

Also in the vicinity of and at the other side of the typefont wheel 311 there is provided a parallel ink roller 316 for applying printing ink to the typefont wheel, said ink roller 316 being rotatably supported, by means of end shafts 317 thereof, on plate-shaped support members 318.

Said support members 318 are pivotably supported approximately in the center thereof by means of shaft 319 so as to displace the ink roller 316 towards or away from the typefont wheel 311.

Said support members 318 are further provided with an escape mechanism 320 which maintains the ink roller 316 in contact with the typefont wheel 311 in the normal state but interrupts said contact when the aforementioned recessed portion 312*a* reaches the position of said ink roller 316.

Figure 59:
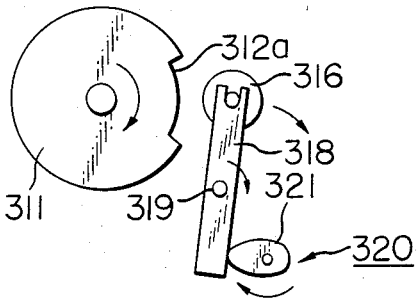

In the embodiment shown in FIG. 57, the escape mechanism 320 is composed of a support member 318 and a cam 321, which is rotated in synchronization with the typefont wheel 311 to maintain the ink roller 316 in contact with the typefont wheel in the normal state but causes a pivoting motion of the support member 318 to separate the ink roller 316 from the typefont wheel 311 when the recessed portion 312*a* of the typefont belts reaches the position of the ink roller 316 as shown in FIG. 59, thus avoiding the collision of the ink roller 316 with the shouldered part of the recessed portion 312*a*.

Said escape mechanism 320 is not limited to the above-explained embodiment but may assume various other structures as shown in the following examples.

Figure 60:
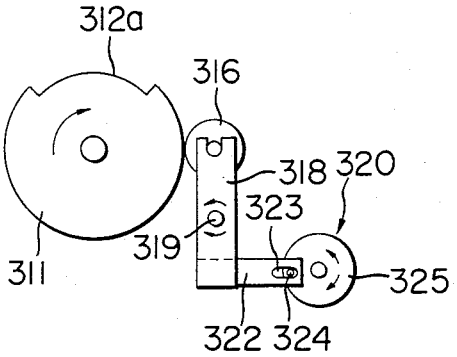
FIGS. 60–63 are lateral views showing still other embodiments of the present invention.

The escape mechanism shown in FIG. 60 comprises a lever 322 fixed at an end thereof to the lower end of the support member 318 and a drive 325 having a pin 324 engaging with an elongated hole 323 provided at the other end of said lever 322 and performing intermittent reciprocating rotary motion. Said drive 325 causes pivoting motion of the support member 318 through said pin 324 and lever 322, thus contacting and separating the ink roller 316 and the typefont wheel 311 at determined timings.

Figure 61:
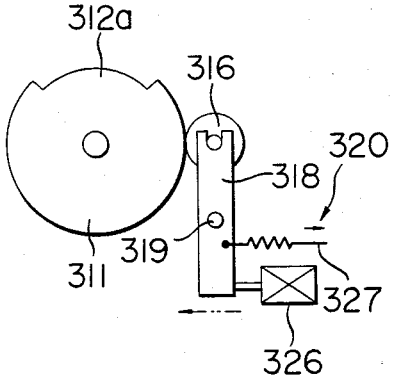

The escape mechanism 320 shown in FIG. 61 is provided with a solenoid plunger 326 which is activated to separate the ink roller 316 from the typefont wheel 311 when the recessed portion reaches the position of the ink roller. A spring 327 is provided for maintaining the ink roller in constant contact with the typefont wheel.

Figure 62:
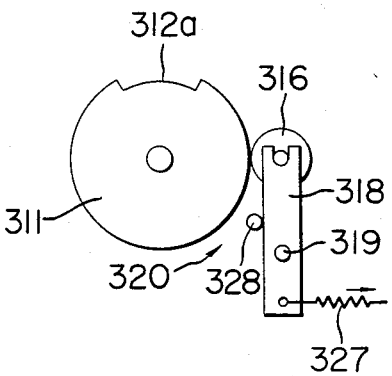

In case of an embodiment shown in FIG. 62, the escape mechanism comprises a stopper 328 which supports the support member 318 so as to achieve a constant contact depth between the ink roller 316 and the typefont wheel 311, thus preventing the ink roller 316 from falling into said recessed portion 312*a*. A spring 327 is provided for the same purpose as in the embodiment shown in FIG. 61.

Figure 63:
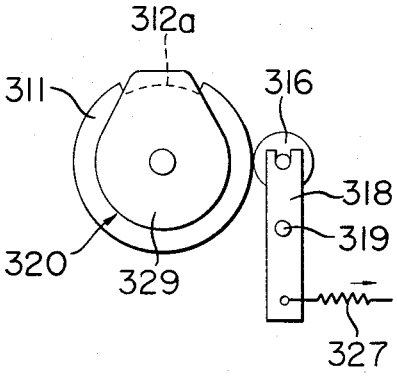

The escape mechanism 320 shown in FIG. 63 is composed of a cam 329 which is provided coaxially with and is rotated integrally with the typefont wheel 311 to expel the ink roller 316 when the recessed portion 312*a* reaches the position of the ink roller 316.

As explained in the foregoing, the printing apparatus of the present invention, because of the absence of impact or shock when the ink roller passes over the recessed portion of the typefont wheel, allows to drive the typefont wheel with a constant torque without causing load fluctuation on the drive source such as a motor. In this manner it is rendered possible to utilize the motor constantly in the optimum state, to reduce the drive energy and to prevent the damage on the ink roller.

What we claim is:

1. A compact printer comprising a typefont wheel provided with printing types and an ink roller for applying printing ink to said printing types, said typefont wheel including a support, a plurality of typefont belts mounted on said support to define plural columns of printing types, each belt being made of an elastic member and having integrally formed on one side thereof a plurality of said printing types and on the other side thereof a plurality of positioning projections, each printing type being associated with a separate positioning projection and the printing types on adjacent typefont belts being arranged in a staggered fashion, said support having a plurality of apertures, wherein adjacent positioning projections on each typefont belt are spaced apart by a distance slightly less than the distance between corresponding apertures on said support, said projections being positioned within the apertures to mount each of said typefont belts on said support under tension over substantially the entire belt, and impact means disposed within said support and including at least one hammer dimensioned to impact types on a plurality of adjacent typefont belts from inside said support by striking the associated projections, wherein the staggered arrangement of types on adjacent typefont belts is such that at any time said hammer can only strike one projection of one of the adjacent typefont belts to transmit an impact force to the associated printing type thereby ensuring rapid and exact printing, and return of the one typefont belt to its original position without affecting the printing types of adjacent typefont belts.

2. A compact printer according to claim 1, wherein said support is of a cylindrical shape, and said typefont belts are formed as independent sheets, said sheets being adapted to be wound around said support.

3. A compact printer according to claim 1, wherein said support is a cylindrical shape, and said typefont belts are formed as sheets each including plural belts united at end portions thereof, said sheets being adapted to be wound around said support.

4. A compact printer according to claim 2 or 3, wherein sheet-shaped typefont belts are provided at both ends thereof with fixing holes which are fitted with fixing bosses provided on said support, said fixing bosses being caulked to securely maintain said fixing holes, thereby securing said typefont belts on said support.

5. A compact printer according to claim 2 or 3, wherein said sheet-shaped typefont belts are provided at both ends thereof with fixing holes which are fitted with fixing bosses having enlarged head portions and provided on said support, thereby securing said typefont belts on said support.

6. A compact printer according to claim 2 or 3, wherein end portions of said typefont belts wound on said support are maintained in position by a plate member which is fixed with a screw to said support, thereby securing said typefont belts on said support.

7. A compact printer according to claim 2 or 3, wherein end portions of said typefont belts wound on said support are maintained in position by a plate member having elastic projections to be fitted into fixing holes in said support, thereby securing said typefont belts on said support.

8. A compact printer according to claim 2 or 3, wherein end portions of said typefont belts wound on said support are respectively fixed with pins to said support.

9. A compact printer according to claim 6, wherein said support is of a cylindrical shape, and said typefont belts are formed as endless belts to be fitted around said support.

10. A compact printer according to claim 1 wherein said plurality of typefont belts are spaced apart.

11. A compact printer comprising a typefont wheel provided with printing types and an ink roller for applying printing ink to said printing types, said typefont wheel including a cylindrical support provided with a plurality of apertures about the periphery of said support, a printing hammer mechanism inside said support, and an elastic member connected to and extended along the outer circumference of said support, said elastic member being composed of a spring member formed of a bent wire material and having positioned therethrough at determined intervals the printing types so that after the printing hammer mechanism strikes any one of the printing types through the associated aperture, the struck type will be rapidly returned to its rest position, wherein said spring member is composed of meandering sections and conical spiral sections alternated at determined intervals, said meandering sections being molded in plastic material while said conical spiral sections serve to support said printing types.

12. A compact printer comprising a typefont wheel provided with printing types and an ink roller for applying printing ink to said printing types, said typefont wheel including a cylindrical support provided with a plurality of apertures about the periphery of said support, a printing mechanism inside said support, and a plurality of elastic members connected to and extended along the outer circumference of said support, said elastic members being provided with printing types arranged in columns with the printing types in adjacent columns arranged in staggered fashion and said printing hammer mechanism including at least one hammer having a width in the axial direction of said typefont wheel so as to strike printing types in a plurality of adjacent type columns, said elastic members each being composed of a spring member formed of a bent wire material and having positioned therethrough at determined intervals the printing types, wherein due to the staggered arrangement of printing types in adjacent columns at any given time the printing hammer can only strike one of the printing types in one of said adjacent columns through the associated aperture, the struck type then being rapidly returned to its rest position.

* * * * *